US010494786B2

(12) United States Patent
Boot et al.

(10) Patent No.: US 10,494,786 B2
(45) Date of Patent: Dec. 3, 2019

(54) FRAME FOR GUIDING AND SUPPORTING A FOUNDATION ELEMENT, THE FRAME COMPRISING A PLURALITY OF GUIDE MECHANISMS

(71) Applicant: IHC HOLLAND IE B.V., Sliedrecht (NL)

(72) Inventors: Arno Herman Boot, Hellevoetsluis (NL); Klaas-Jan Mulderij, Delft (NL)

(73) Assignee: IHC HOLLAND IE B.V., Sliedrecht (NL)

( * ) Notice: Subject to any disclaimer, the term of this patent is extended or adjusted under 35 U.S.C. 154(b) by 0 days.

(21) Appl. No.: 16/077,383

(22) PCT Filed: Mar. 9, 2017

(86) PCT No.: PCT/NL2017/050148
§ 371 (c)(1),
(2) Date: Aug. 10, 2018

(87) PCT Pub. No.: WO2017/155402
PCT Pub. Date: Sep. 14, 2017

(65) Prior Publication Data

US 2019/0048551 A1 Feb. 14, 2019

(30) Foreign Application Priority Data

Mar. 9, 2016 (NL) ..... 2016401

(51) Int. Cl.
*E02D 13/04* (2006.01)
*E02D 27/52* (2006.01)
*E02D 13/00* (2006.01)

(52) U.S. Cl.
CPC ..... *E02D 13/04* (2013.01); *E02D 13/005* (2013.01); *E02D 27/52* (2013.01)

(58) Field of Classification Search
CPC ..... E02D 13/04; E02D 27/52; E02D 27/50; E02D 27/14; E02B 17/02; E02B 17/027;
(Continued)

(56) References Cited

U.S. PATENT DOCUMENTS 4,102,147 A 7/1978 Jansz
4,214,843 A * 7/1980 Rohde ..... E02B 17/0008 405/203
(Continued)

FOREIGN PATENT DOCUMENTS

EP 2492402 A1 8/2012
EP 2554752 A1 2/2013
(Continued)

OTHER PUBLICATIONS

International Search Report dated Apr. 27, 2017 for corresponding International Application PCT/NL2017/050148, filed Mar. 9. 2017.
(Continued)

*Primary Examiner* — Frederick L Lagman
(74) *Attorney, Agent, or Firm* — Steven M. Koehler; Westman, Champlin & Koehler, P.A.

(57) ABSTRACT

A frame for guiding and supporting a foundation element, such as a pile, during installation in an underwater ground formation comprises a plurality of guide mechanisms that are movable between an extended position to engage a pile located inside the frame and a retracted position. At least one of the guide mechanisms comprises a slider, a path supporting the slider, a rotatable link, and an actuator to move the slider along the path and the link between said extended and retracted positions.

15 Claims, 2 Drawing Sheets

(58) Field of Classification Search
CPC ..... E02B 2017/0039; E02B 2017/0043; E02B 2017/0091
USPC ..... 405/227
See application file for complete search history.

(56) References Cited

U.S. PATENT DOCUMENTS 4,537,533 A 8/1985 Hampton
4,540,314 A * 9/1985 Falkner, Jr. ..... B63B 21/502 114/265
4,589,802 A * 5/1986 Hampton ..... E21B 7/128 405/224
4,674,920 A * 6/1987 Regan ..... E02B 17/00 405/227
4,687,062 A * 8/1987 Beghetto ..... E21B 41/08 166/366
5,040,607 A * 8/1991 Cordeiro ..... E21B 43/017 166/339
5,722,796 A * 3/1998 Halvorsen ..... E21B 43/017 166/341
6,994,493 B2 * 2/2006 Jones ..... E02D 13/04 405/227
8,672,587 B2 * 3/2014 Mack ..... E02D 31/002 405/227
2011/0170956 A1 * 7/2011 Vandenbulcke ..... E02D 27/42 405/227
2012/0014753 A1 * 1/2012 Jung ..... E02D 13/00 405/227
2012/0213593 A1 * 8/2012 Vandenbulcke ..... E02D 13/04 405/227
2012/0213594 A1 * 8/2012 Vandenbulcke ..... E02D 13/04 405/228
2013/0183101 A1 * 7/2013 Vandenbulcke ..... E02D 13/04 405/204
2014/0154015 A1 6/2014 Jung et al.
2015/0284927 A1 * 10/2015 Gunter ..... E02D 9/04 405/232
2018/0106007 A1 * 4/2018 Mack ..... E02D 7/02

FOREIGN PATENT DOCUMENTS

JP 62078309 A * 4/1987
JP H0849235 A 2/1996
WO 2012177131 A1 12/2012
WO 20150187015 A1 12/2015

OTHER PUBLICATIONS

Written Opinion of the International Searching Authority dated Apr. 27, 2018 for corresponding International Application PCT/NL2017/050148, filed Mar. 9, 2017.

* cited by examiner

FRAME FOR GUIDING AND SUPPORTING A FOUNDATION ELEMENT, THE FRAME COMPRISING A PLURALITY OF GUIDE MECHANISMS

CROSS-REFERENCE TO RELATED APPLICATION

The present application is a national stage of and claims priority of International patent application Serial No. PCT/NL2017/050148, filed Mar. 9, 2017, and published in English as WO 2017/155 the content of which is hereby incorporated by reference in its entirety.

BACKGROUND

An aspect of the invention relates to a frame for guiding and supporting a foundation element, such as a pile, during installation in an underwater ground formation, the frame comprising a plurality of guide mechanisms that are movable between an extended position to engage a pile located inside the frame and a retracted position. The invention also relates to a method of installing a plurality of foundation elements.

Some structures require other Solutions than a monopile. For instance, for wind turbines the diameter of the required monopile increases with the depth of the waters where the wind turbines are to be installed. Depths exceeding e.g. 30 meters may require such dimensions that a monopile is impractical or indeed impossible. In such circumstances, a jacket, such as a so-called tripod, provides a suitable alternative. Jackets are also used in other applications, e.g. for oil and gas platforms and for supporting water current (tidal) energy plants.

SUMMARY

A frame has at least one of the guide mechanisms comprising a slider, e.g. a slide shoe, a path supporting the slider, e.g. a guide surface or one or more beams or rails, a rotatable link for transferring loads from a foundation element to the frame, preferably a link rotatably connected to the slider, and an actuator to move the slider along the path and the link between said extended and retracted positions. In an embodiment, the actuator is a linear actuator, preferably a hydraulic cylinder.

The guide mechanism enables a relatively large stroke of the guide mechanism(s) rendering the frame suitable for guiding and supporting a relatively large range of pile diameters. Further, the guide mechanism(s) allow compact configuration and/or transfer of loads from the foundation element to the frame via the link and the shoe, with limited or no load on the linear actuator.

To further facilitate compact configuration of the guide mechanism, in an embodiment, the linear actuator extends parallel to the imaginary central axis of the frame, which, if the frame comprises a guide sleeve, typically coincides with the imaginary central axis of the sleeve and, during installation of a foundation element, with the imaginary central axis of that element.

In an embodiment, the linear actuator has a stroke of at least 0.5 meter, preferably at least 0.7 meter. In another embodiment, the link is exchangeable with a link of a different length. In a refinement, the various links have a length in a range from 0.2 to 0.8 meter. These embodiments enable a further increase of the range of pile diameters, e.g. to a range from 1.8 to 3 meters or wider even.

In a further embodiment, to enhance the direct transfer of the loads from the foundation element to the frame via the link, in the extended position of the guide mechanism, the link extends at least substantially radially and/or at least substantially perpendicular to the imaginary central axis of the frame. In a refinement, the link extends within 5° from a radius of and at an angle in a range from 80° to 100° with the imaginary central axis of the frame.

To further enhance the robustness of the guide mechanism(s), in an embodiment, at least one of the guide mechanisms comprises a stop defining the extended position, e.g. by serving as a stop for the slider.

In another embodiment, at least one of the guide mechanisms comprises a second link rotatably connected to the (first) link. It is preferred that one end of the second link is rotatably connected to the distal end of the (first) link and the other end of the second link is rotatably connected to the frame, preferably near the actuator. The second link provides a defined and secure path of the (first) link between the extended and retracted positions.

To improve guiding, especially during lowering the foundation element in the sleeve and during driving the foundation element, it is preferred that guide elements are located at least near the bottom of the sleeve and in its upper half. In an embodiment, the frame comprises two sets of guide mechanisms, e.g. three to ten mechanisms in each set, preferably at least a first set in the upper half, e.g. near the top of the sleeve and in its upper half and a second set in the lower half, e.g. near the bottom) of the sleeve and in its upper half.

In another embodiment, to robustly guide and support the (first) link, one end of the second link is rotatably connected to the distal end of the (first) link and the other end of the second link is rotatably connected to the frame, preferably near the actuator.

In another embodiment, the frame comprises a tubular sleeve and the slider and the linear actuator are located on the outside of the sleeve. Thus, the risk of contacting the guide mechanism(s) during the initial placing of a foundation element in the frame is reduced or avoided and the mechanisms can be reached from outside the frame, e.g. in case of malfunction of (one of) the actuator(s).

To reduce input of noise into the surrounding water, the sleeve is a sound-insulating sleeve that reduces the noise input from the installation of the foundation element, in particular pile driving, by at least 10 dB, preferably at least 15 dB for frequencies lower than 1000 Hz. In general, it is preferred that the sum of all measures aimed at attenuating noise, results in a total reduction of the noise input from the driving by at least 10 dB, preferably at least 15 dB for frequencies lower than 1000 Hz, when compared to driving without a sleeve.

The invention also relates to a template for use in installing a plurality of foundation elements, in particular piles, comprising a plurality of frames for guiding and supporting a foundation element as described above.

The invention further relates to a method of adjusting a frame for guiding and supporting a foundation element, such as a pile, during installation in an underwater ground formation, the frame comprising a plurality of guide mechanisms that are movable between an extended position to engage a pile located inside the frame and a retracted position, at least one of the guide mechanisms comprising a slider, a path supporting the slider, a link rotatably connected to the slider, and an actuator to move the slider along the path and the link between said extended and retracted positions, which method comprises the steps of selecting a foundation element, calculating the length(s) of the link(s) appropriate for the diameter of the selected foundation element, if required removing the link(s) present, placing the link(s) in the guide mechanism(s), e.g. replacing the links present with links having a different length, adjusted to the foundation element. This method enables adapting the frame to a wider range of foundation element shapes and diameters and facilitates that, in the extended position of the guide mechanisms, the links extend at least substantially perpendicular to the imaginary central axis of the frame, preferably at an angle in a range from 80° to 100° with the imaginary central axis of the frame.

BRIEF DESCRIPTION OF THE DRAWINGS

Aspects of the invention will now be explained in more detail with reference to the Figures, which show preferred embodiments of a pile guiding frame according to the present invention.

DETAILED DESCRIPTION

It is noted that the Figures are schematic in nature and that details, which are not necessary for understanding the present invention, may have been omitted.

Figure 1:
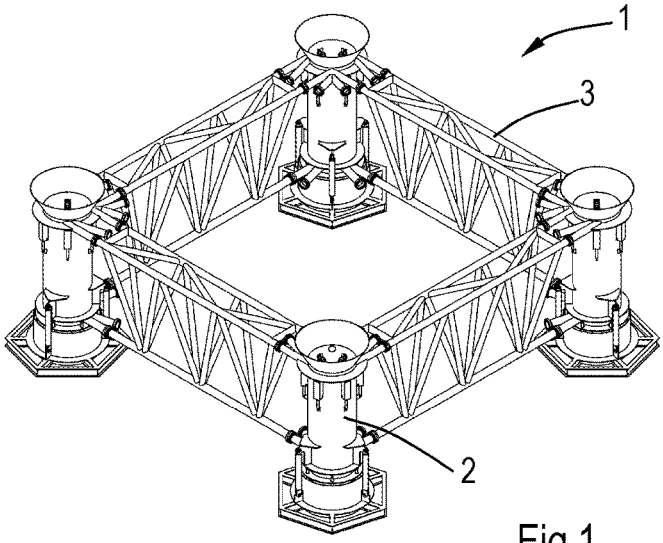
FIGS. 1 and 2 are perspective views of templates comprising three respectively four guiding frames.
Figure 2:
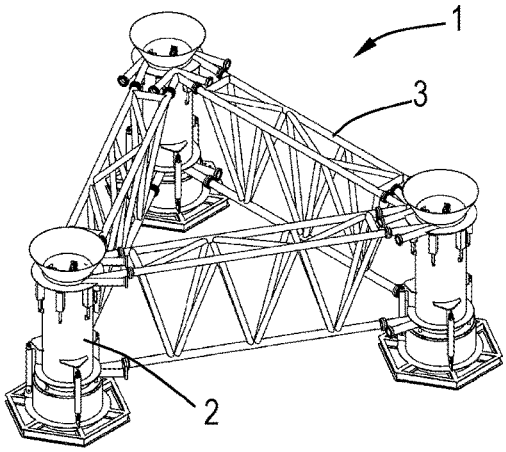

FIGS. 1 and 2 show templates 1 comprising a plurality of guiding frames 2 fixed in a geometric pattern by means of beams or trusses 3. The pattern of the centerlines of the guiding frames corresponds to that of the foundation elements of e.g. a jacket for a wind turbine to be installed. In these examples, the guiding frames are arranged in a triangle (FIG. 1) and in a square (FIG. 2). The templates are provided with sensors (not shown) to establish whether the template is horizontal or at an inclination.

Figure 3:
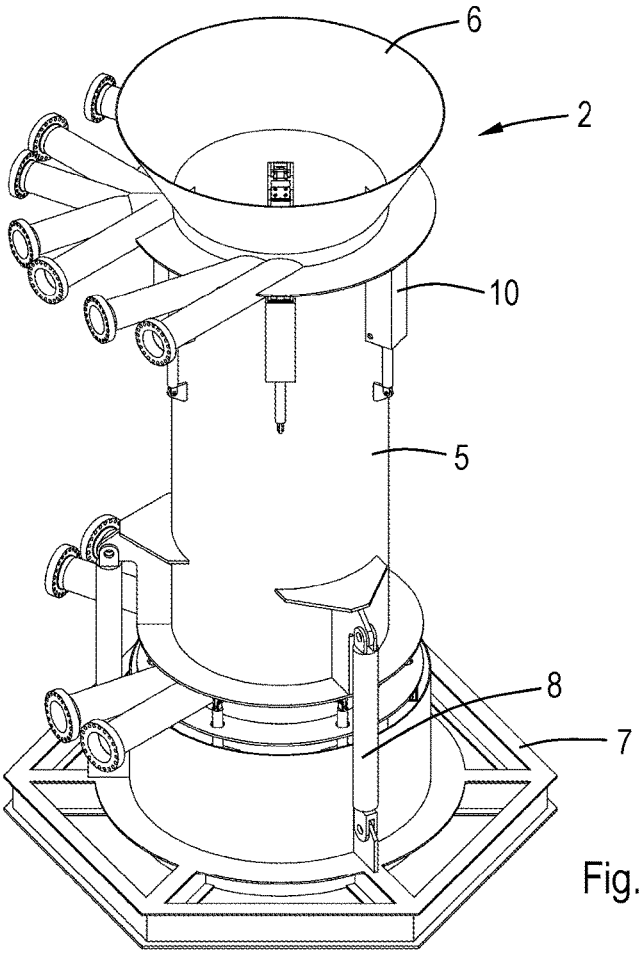
FIG. 3 is perspective view of a guiding frame comprising extendable and retractable guide mechanisms.
Figure 4A:
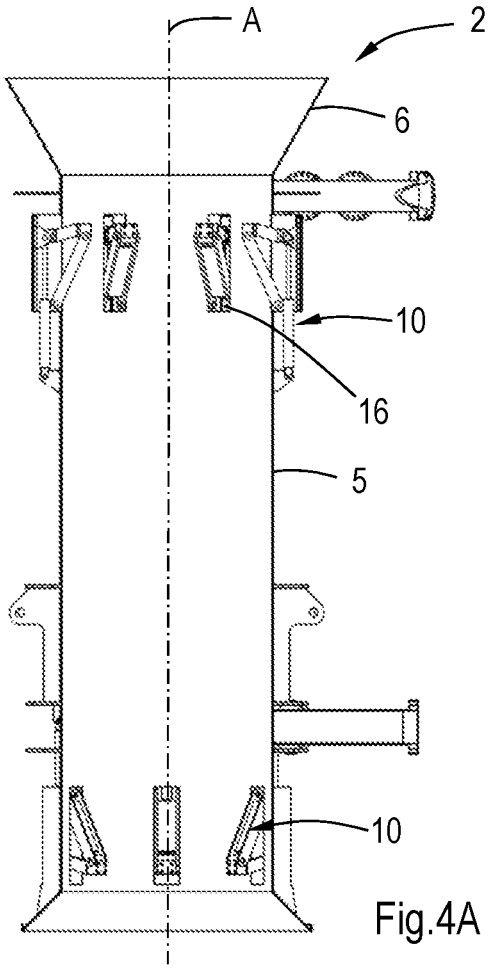
FIGS. 4A to 4D are cross-sections of the guiding frame shown in FIG. 3.

Each of the guiding frames, shown in more detail in FIGS. 3 and 4A, comprises a sleeve 5, made of e.g. steel, for surrounding a pile during driving. The sleeve has a circular cross-section, can be double walled, and has an inner diameter of 3 meters. The top end of the sleeve is provided with means for centering a pile when it is led down into the sleeve, e.g. an open cone or flare 6.

To reduce or substantially avoid excessive penetration of the template into the seabed under its own weight and to adjust the sleeves to a sufficiently exact vertical and the template to a sufficiently exact horizontal position, the bottom end of the sleeve is provided with a so-called mud mat 7 or foot that is operated with a plurality of hydraulic cylinders 8 extending between the mud mat and the outer wall of the sleeves.

Each sleeve comprises two sets of guide mechanisms 10, in this example eight mechanisms in each set, a first set near the top of the sleeve and a second set near the bottom of the sleeve. Each mechanism, best shown in FIGS. 4B to 4D, comprises a slider 11, a path 12 supporting the slider, a first link rotatably connected to the slider, e.g. a slide shoe 13, and a hydraulic cylinder 14 having a stroke of e.g. 900 mm to move the slider along the path and the link between an extended position to engage a pile located inside the frame and a retracted position. A second link 15 is rotatably connected to the distal end of the first link and the other end of the second link is rotatably connected to the frame, preferably near the hydraulic cylinder 14.

The hydraulic cylinders 14 are positioned and secured to the outer wall of the sleeve 5 and extend parallel to the imaginary central axis A of the sleeve (vertically in the Figures). The paths for the sliders 11, in this example guide chutes 12, are also attached, e.g. welded, to the outer wall of the sleeve. The sliders, a part of the hydraulic cylinders, and the first and second links are located inside the chutes. The wall of the sleeve is provided with openings 16 to enable the first and second links 13, 15 to enter the inside of the sleeve. Further, each of the guide mechanisms comprises a stop 17 defining the extended position.

Figure 4B:
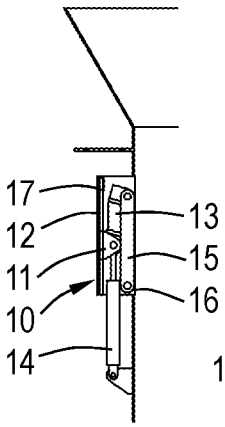
Figure 4C:
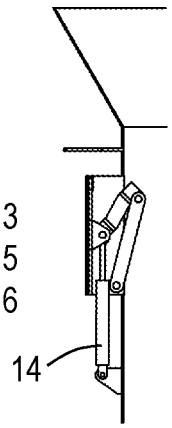
Figure 4D:
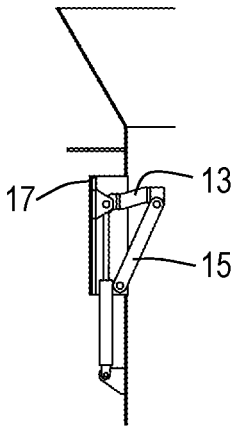

FIGS. 4B to 4D show how the mechanisms move from the retracted position to the extended position. In the retracted position (FIG. 4B), the hydraulic cylinder 14 and the first and second links 13, 15 are all oriented vertically. When the hydraulic cylinder moves the slider up (FIG. 4C), the first and second links incline towards the center of the sleeve 5, i.e. to a pile present in the sleeve. When the slider engages the stop (FIG. 4D), the mechanism is in the extended position, the first link extends radially and substantially perpendicular to the imaginary central axis A of the sleeves, and the distal end of the first link 13 engages a pile (not shown) in the sleeve.

An example of guiding and supporting a pile comprises the following steps: the length of the (first) links appropriate for the diameter of the pile is calculated, if required the links already present are replaced with links having the calculated length, the frame (standalone or as part of a template) is lowered onto a seabed and adjusted, by means of the mud mat, to an exact vertical position. A pile is lowered into the frame and the guide mechanisms are extended to guide the pile, the pile is allowed to sink into the seabed under its own weight, a pile driver is placed on the top end of the pile by means of a driver sleeve, and the pile is driven into the seabed. When the driver sleeve reaches the upper set of guide mechanisms, these mechanisms are retracted to enable the driver sleeve to pass. The lower set of guide mechanisms is retracted when (and if) the sleeve reached this set.

The guide mechanism is a compact design and yet it is suitable for a wide range of pile diameters. Further, loads on the hydraulics are reduced or avoided.

Figure 5A:
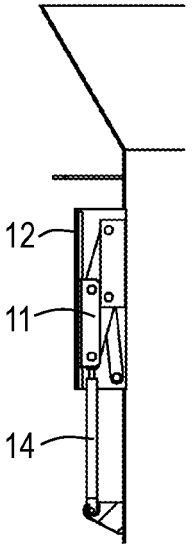
FIGS. 5A to 5C are cross-sections of guiding frame having guide mechanisms in parallelogram configuration.
Figure 5B:
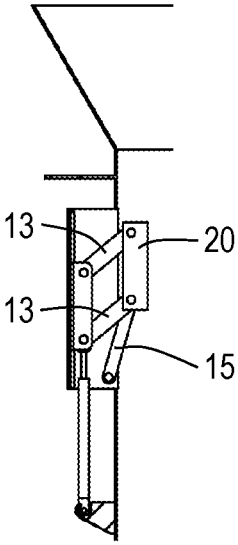
Figure 5C:
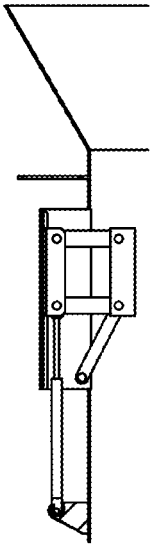

The invention is not restricted to the embodiment described above and can be varied in numerous ways within the scope of the claims. E.g., FIGS. 5A to 5C show an embodiment comprising two (first) links 13 forming, together with the slider 11 and a guiding element 20 for the pile a parallelogram. Thus, the surface area of the slider and of the contact with the pile are increased. In another variation, the slider is part of or formed in the housing of the hydraulic cylinder (actuator) and one of the links is rotatably attached to the housing. In a refinement of this variation, the first link is rotatably fixed to the frame, the cylinder rod is fixed to the frame, e.g. at or near the first link, and the second link is rotatably attached to the first link and the housing of the hydraulic cylinder. Thus, by sliding the housing along a support, e.g. a rail or other path, on the frame, the first link can be moved between the extended and retracted positions.

The invention claimed is:

1. A frame for guiding and supporting a foundation element during installation in an underwater ground formation, the frame comprising a plurality of guide mechanisms that are movable between an extended position configured to engage the foundation element when located inside the frame and a retracted position, wherein at least one of the guide mechanisms comprises a slider, a path located on the frame and supporting the slider, a rotatable link coupled to the slider, and an actuator to move the slider along the path and the link between said extended and retracted positions.

2. The frame according to claim 1, wherein the actuator is a linear actuator.

3. The frame according to claim 1, wherein the linear actuator extends parallel to the imaginary central axis of the frame.

4. The frame according to claim 2, wherein the linear actuator has a stroke of at least 0.5 meter.

5. The frame according to claim 1, wherein the link is rotatably connected to the slider.

6. The frame according to claim 1, wherein the link is exchangeable with a link of a different length.

7. The frame according to claim 1 wherein, in the extended position of the guide mechanism, the link extends at least substantially radially and/or at least substantially perpendicular to the imaginary central axis of the frame.

8. The frame according to claim 1, wherein at least one of the guide mechanisms comprises a stop defining the extended position.

9. The frame according to claim 1, wherein at least one of the guide mechanisms comprises a second link rotatably connected to the link.

10. The frame according to claim 9, wherein a first end of the second link is rotatably connected to a distal end of the link and a second end of the second link is rotatably connected to the frame.

11. The frame according to claim 1, wherein the distal end of the first link is provided with a wheel or slide pad.

12. The frame according to claim 1, comprising two sets of guide mechanisms, wherein at least a first set is in an upper half of the frame and at least a second set is disposed in a lower half of the frame.

13. The frame according to claim 1, wherein the frame comprises a tubular sleeve and the slider and the linear actuator are located on an outside of the sleeve.

14. The frame according to claim 13, wherein the sleeve is a sound-insulating sleeve that reduces noise input from installation of the foundation element.

15. A method of adjusting a frame for guiding and supporting a foundation element during installation in an underwater ground formation, the frame comprising a plurality of guide mechanisms that are movable between an extended position to engage the foundation element located inside the frame and a retracted position, at least one of the guide mechanisms comprising a slider, a path located on the frame and supporting the slider, a link rotatably connected to the slider, and an actuator to move the slider along the path and the link between said extended and retracted positions, which method comprises the steps of selecting a foundation element, calculating a length of each link appropriate for a diameter of the selected foundation element, and placing each link in respective guide mechanism.

* * * * *